US006628054B1

(12) United States Patent
Busai et al.

(10) Patent No.: US 6,628,054 B1
(45) Date of Patent: Sep. 30, 2003

(54) BASE FOR LOW PRESSURE DISCHARGE LAMPS

(75) Inventors: Gyula Busai, Budapest (HU); Györgyi Horváth, Budapest (HU)

(73) Assignee: General Electric Company, Schenectady, NY (US)

( * ) Notice: Subject to any disclaimer, the term of this patent is extended or adjusted under 35 U.S.C. 154(b) by 173 days.

(21) Appl. No.: 09/687,014

(22) Filed: Oct. 13, 2000

(51) Int. Cl.[7] ..... H01J 5/48

(52) U.S. Cl. ..... 313/318.01; 313/318.09; 313/318.1; 439/612

(58) Field of Search ..... 313/318.01, 318.05, 313/318.09, 318.1; 439/612, 611

(56) References Cited

U.S. PATENT DOCUMENTS

| | | | | |
|---|---|---|---|---|
| 4,013,335 A | * | 3/1977 | Varkonyi et al. | 339/144 R |
| 4,221,453 A | | 9/1980 | Wagener | 339/149 |
| 4,295,076 A | | 10/1981 | Eckhardt et al. | 313/223 |
| 4,371,807 A | | 2/1983 | Eckhardt | 313/318 |
| 4,489,252 A | | 12/1984 | Eckhardt | 313/318 |
| 5,105,119 A | * | 4/1992 | Dayton | 313/318 |
| 5,254,025 A | * | 10/1993 | Spaulding et al. | 445/26 |
| 5,296,780 A | * | 3/1994 | Haraden et al. | 313/318 |
| 5,432,400 A | | 7/1995 | Spaulding et al. | 313/318.02 |
| 5,550,422 A | * | 8/1996 | Sules et al. | 313/25 |
| 5,729,080 A | * | 3/1998 | Verspaget et al. | 313/318.01 |

FOREIGN PATENT DOCUMENTS

DE 198 56 871 6/2000

OTHER PUBLICATIONS

PCT International Search Report mailed Mar. 21, 2002.

* cited by examiner

*Primary Examiner*—Robert H. Kim
*Assistant Examiner*—Jurie Yun
(74) *Attorney, Agent, or Firm*—Fay, Sharpe, Fagan, Minnich & McKee, LLP

(57) ABSTRACT

A lamp base in combination with a low pressure discharge lamp is provided. The low pressure discharge lamp comprises a glass envelope which has an end portion and an axis. A stem is melted into the end portion of the envelope in a gas-tight manner in order to form a seal region. The stem is mounted with an electrode and includes a current in-lead which is connected to the electrode. The lamp base comprises a metallic base shell which is fitted to the seal region. A resilient insert is disposed substantially in the base shell. The resilient insert embraces the seal region ant least partly, and fits resiliently to an interior surface of the base shell. The insert has means suitable for positioning the lamp base in cooperation with further means formed on the surface of the seal region.

7 Claims, 4 Drawing Sheets

BASE FOR LOW PRESSURE DISCHARGE LAMPS

FIELD OF THE INVENTION

This invention relates to a base for low pressure discharge lamps, and, more particularly, to a base structure which allows the base to be fixed to the lamp envelope without the need for basing cement.

BACKGROUND OF THE INVENTION

The base of a low pressure discharge lamp provides for the electrical and mechanical connection of the lamp to a socket. Generally, a lamp base comprises a metallic or plastic base shell fitted to an end portion of the lamp envelope and contact elements responsible for electrically and mechanically connecting the lamp to the socket. In the event that the base shell is made of metal, an end portion of the base shell is closed by an insulator disc which embeds one or two base studs to which the lamp lead wires are electrically secured.

U.S. Pat. No. 4,221,453 discloses a low pressure discharge tube which has a base made of elastic, bendable, thermoplastic material. The base shell has an annular wall with knobs protruding inwardly. When the base shell is fitted to the tube, the annular wall elastically deforms and the knobs snap into a groove formed in an end portion of the tube. The base shell has also a frontal portion which closes the tube. This base structure suffers form several drawbacks. One drawback is that the material of which the whole base shell is made has bad thermal conductivity. A linear low pressure discharge tube, in which the additive in the gas fill is liquid mercury, has a cold spot in the vicinity of the base. An appropriate quantity of mercury is condensed in the cold spot in order to ensure an optimum mercury vapor partial pressure in the tube. Owing to the bad thermal conductivity of the base material, the base will not cool the cold spot sufficiently. Another drawback is that the base made of thermoplastic material may deform at unfavorable circumstances due to the heat generated by the lamp during its operation. A further draw back is that the base made wholly of thermoplastic material is susceptible to aging and inflammable.

U.S. Pat. No. 5,432,400 describes a lamp base structure which allows the lamp base to be retained on the end portion of the lamp without the need for basing cement. The lamp base includes a metallic base shell which has an annular flange. This flange is heated prior to fitting over the end portion of the lamp envelope. Cooling of the flange after fitting reduces the flange diameter thereby providing an interference fit with the end portion.

This base structure represents a simple and straightforward solution to the problem of fixing the base to the lamp envelope without basing cement however has drawbacks, as well. In the case of low pressure discharge lamps with small diameter tube, the surface along which the interference fitting comes into being is also small and the lamp base can turn around the end portion on the effect of relatively small torque. Standards require that the lamp base must withstand a torque of 1. 5 Nm, and this requirement cannot be securely met at tube diameters smaller then one inch. An appropriate cooling of the cold spot of the lamp can hardly be accomplished since the annular flange of the base shell contacts with the glass tube on a relatively small surface. This can lead to a reduction in lumen output of the lamp. At low pressure discharge tubes generally, a stem mounted with electrode is melted into the end portion of the tube to form a sealing region, most often a seal region portion. Owing to this manufacturing process, dimensions of the sealing region have a great variation which leads to a similarly great variation in the tightening force arising between the lamp and the lamp base as well as in the surface conducting the heat away from the cold spot. When the base shell with the annular flange is snapped onto the seal region portion of the glass tube, the glass can easily be got damaged. Last but not least, the manufacturing process of this base structure needs special equipment which properly heats up the flange of the metallic base shell. This makes the manufacturing process relatively difficult.

Thus there is a particular need for a base structure without base cement which provides sufficiently great tightening force with small variation between the glass tube and the base even in the event of small diameter tubes, provides for an appropriate cooling of the end portion of the tube, and does not require special equipment for its manufacturing.

BRIEF SUMMARY OF THE INVENTION

As an exemplary embodiment of the present invention, a lamp base in combination with a low pressure discharge lamp is provided. The low pressure discharge lamp comprises a glass envelope which has an end portion and an axis. A stem is melted into the end portion of the envelope in a gas-tight manner in order to form a seal region. The stem is mounted with an electrode and includes a current in-lead which is connected to the electrode. The lamp base comprises a metallic base shell which is fitted to the seal region. A resilient insert is disposed substantially in the base shell. Said resilient insert embraces the seal region at least partly, and fits resiliently to an interior surface of the base shell. Said insert has means suitable for positioning the lamp base in cooperation with further means formed on the surface of the seal region. The base shell has an end portion closed al least partly by an insulator piece which embeds a base stud made of metal. The base stud is connected to the current in-lead.

The proposed base structure has a number of advantages over the prior art represented by the patents cited above. One advantage is that this structure provides a sufficient tightening force between the end portion of the envelope of the lamp and the base shell due to the resilient insert fitting to the inner surface of the base shell and connecting with the seal region of the envelope through the positioning means. This tightening force is practically independent from the size of the envelope. Another advantage is that this base structure provides appropriate cooling for the cold spot in the envelope due to the metallic base shell which contacts with the glass envelope on a relatively large surface primarily through the resilient insert. A further advantage over U.S. Pat. No. 5,432,400 is that the manufacturing process of this base structure does not require a step which is unusual in lamp basing and needs special equipment. A still further advantage is that the proposed base structure is durable and is not apt to take fire.

DETAILED DESCRIPTION OF THE INVENTION

Figure 1:
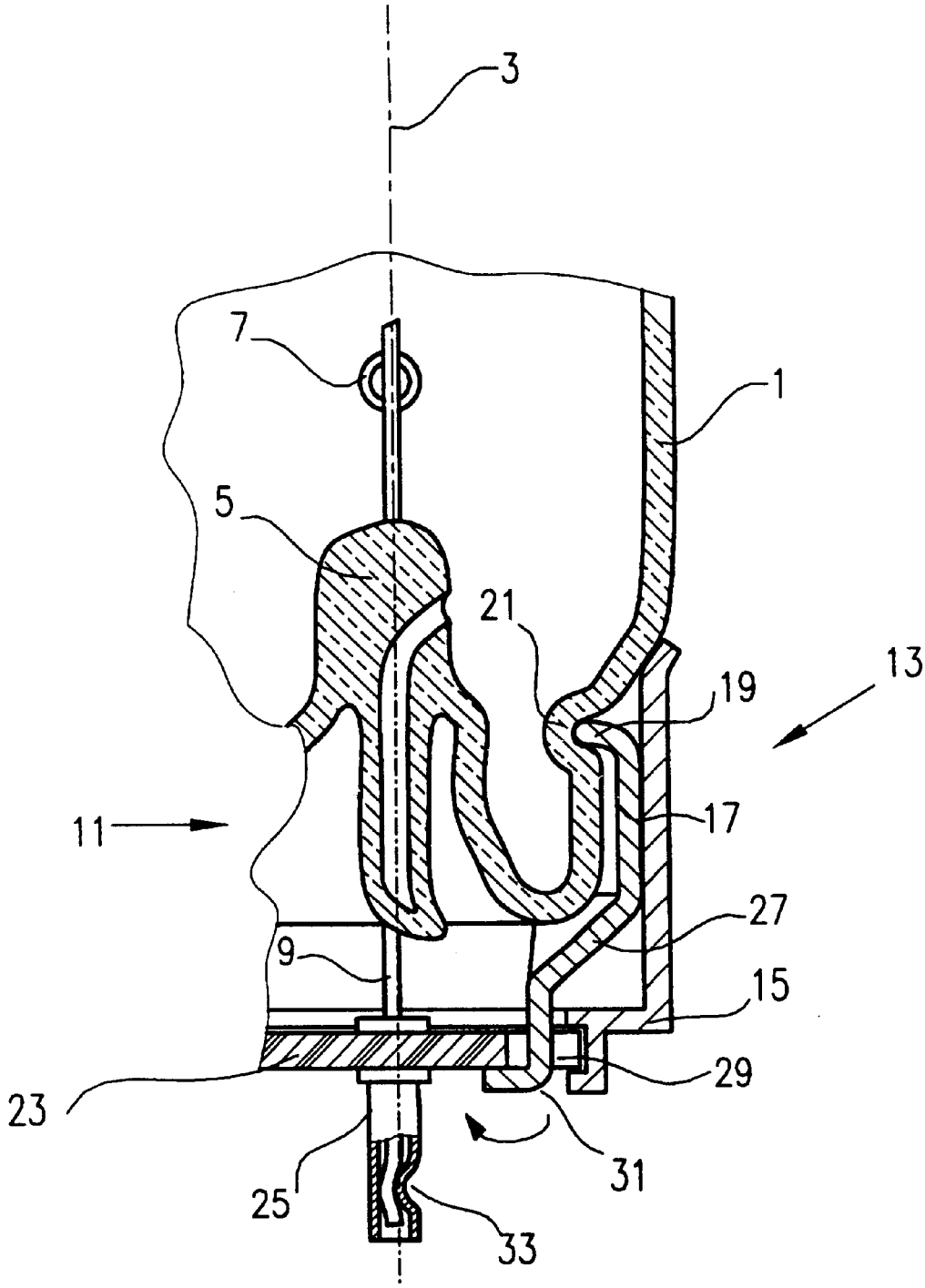
FIG. 1 shows an axial section of an assembled lamp base in which the present invention is embodied.

Referring now to FIG. 1, a lamp base 13 mounted on an end portion of a low pressure discharge lamp is illustrated. The lamp comprises a glass envelope 1 that has an axis 3. Although the figure does not show, the envelope 1 is coated with phosphor on an interior surface thereof, and is filled with noble gas and mercury needed for the discharge in a manner known to a person skilled in the art. The envelope 1 is hermetically sealed and includes a stem 5 which has current in-leads 9 embedded therein and an electrode 7 mounted thereon. The sealing may be made by a glass-melting process during which a mould is applied in order to form a well-defined shape for the end portion of the low pressure discharge lamp. This shape is characterised by a seal region 11 extending axially from the envelope 1 with a diameter smaller than the diameter of the envelope 1. To the seal region 11, the lamp base 13 is fitted that comprises a base shell 15 made of metal e.g. aluminium. To the end of the base shell, an insulator piece 23 made of fibreglass plastic is attached for fixing base studs 25. The base studs 25 have a hollow therein and provide electrical and mechanical connection to a socket of a fixture of the lamp. The ends of the current in-leads 9 are connected to the hollow base studs 25 by crimping 33. The lamp base 13 is fixed to the seal region 11 of the lamp by a resilient insert 17 made of flexible material, e.g. steel, aluminum, nickel alloy. In the embodiment shown in FIGS. 1 and 2, the insert 17 is a C-shaped sleeve with first tabs 27 at its one end and with means 19 formed as two second tabs 19 at its other end. Two first tabs 27 (shown clearly in FIG. 2) connect to the is insert 17 with a portion which is bent inwardly gradually closer the axis 3 and is narrowing towards the insulator piece 23 into a tongue 31 which extends substantially parallel to the axis 3. The tongues 31 are put through apertures 29 which are cut in the insulator piece 23. The ends of the tongues 31 are bent back on the outer surface of the insulator piece 23 shown by the arrow. The second tabs 19 protrude from the other end of the insert 17 and are bent radially inwardly towards the axis 3 and fit to respond further means 21 formed as recesses 21 being sunk in the surface of the seal region 11. The insert 17 embraces almost the whole seal region 11 providing a sufficient tightening force between the seal region 11 of the envelope 1 and the base shell 15. The insert 17 also provides a thermal bridge between the seal region 11 and the base shell 15 and serves as a heat sink in order to cool the cold spot of the low pressure discharge lamp.

Figure 2:
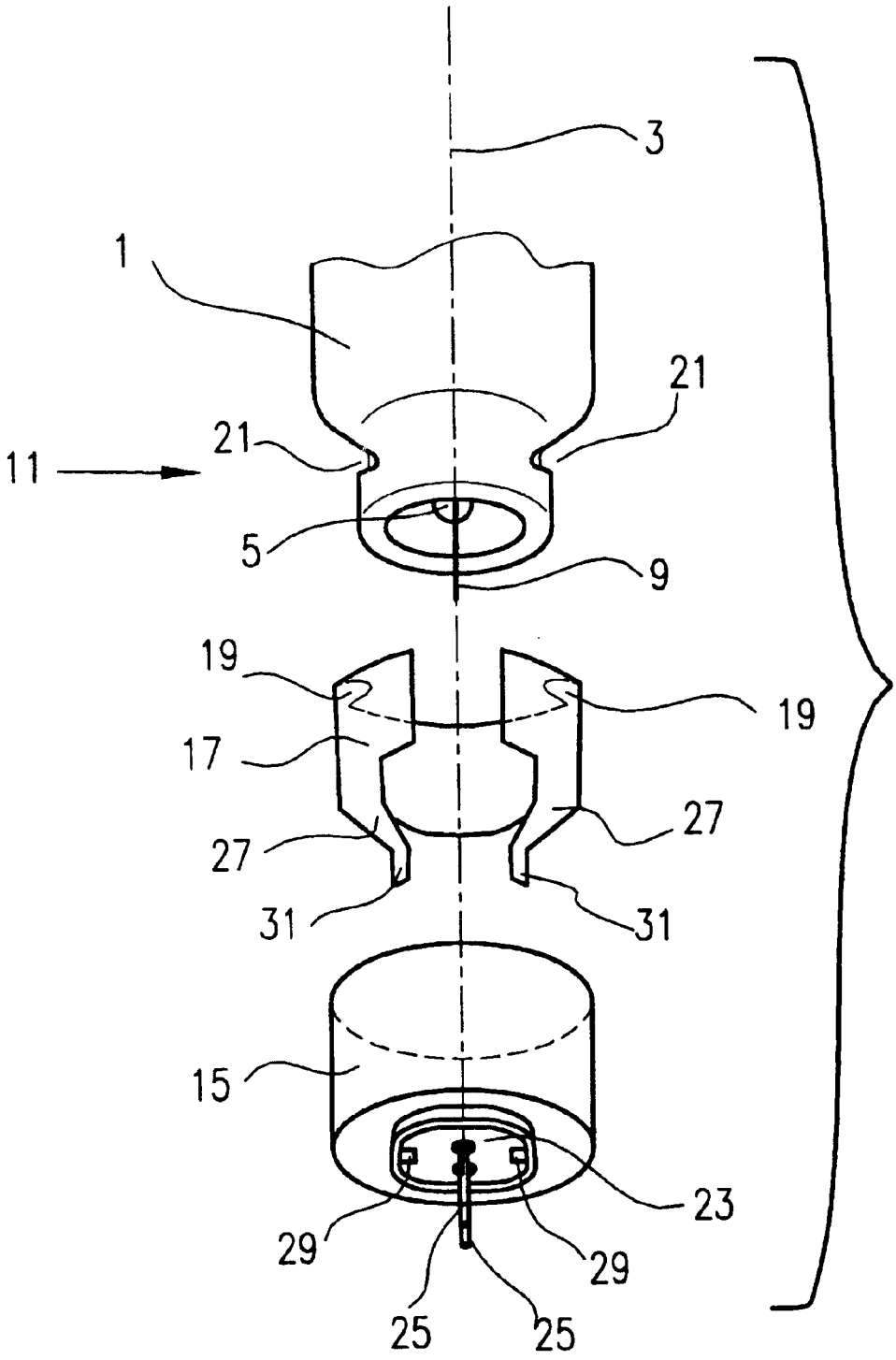
FIG. 2 is an exploded view of the lamp base of FIG. 1.

In FIG. 2, the base shell 15, the insert 17 and the envelope 1 are illustrated separately in an exploded view in order to explain the assembly process of the lamp base 13. The sealed envelope 1 with the seal region 11 is provided from the end portion of which the current in-leads 9 extend. The insert 17 is to be pulled on the seal region 11 so that its C-shaped body widens out until the second tabs 19 resiliently snap into the recesses 21. Then the base shell 15 with the insulator piece 23 and the base studs 25 is to be pulled over the insert 17 so that the tongues 31 and the current in-leads 9 are threaded in the apertures 29 and in the base studs 25, respectively. Pulling the base shell 15 over the insert 17, it fits resiliently to an interior surface of the base shell 15. This is accomplished by forming the mantle of the insert 17 slightly ellipsoidal. The larger diameter portion of the insert 17 leans against the inner surface of the base shell 15, the smaller diameter portion with the second tabs 19 clinches the outer surface of the seal region 11. Forming the insert 17 as an ellipsoidal C-shaped body is a preferred construction, however an insert 17 with a circular C-shaped body also remains within the scope of the present invention. Finally, the tongues 31 are bent back and the current in-leads 9 are crimped as it has already been described with respect to FIG. 1.

Figure 3:
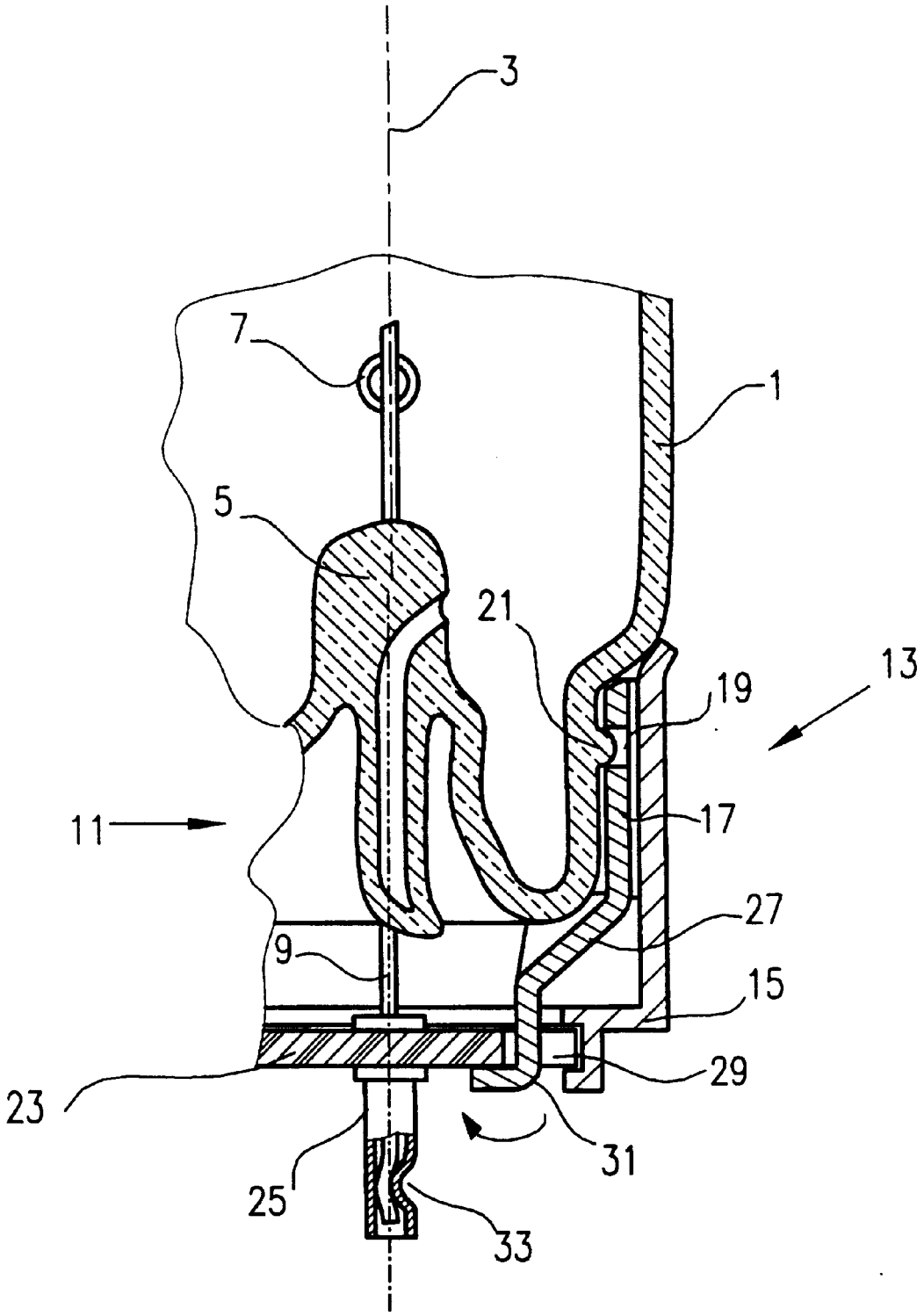
FIG. 3 shows an axial section of a further embodiment of the lamp base.

FIG. 3 shows another embodiment of the lamp base 13. The envelope 1 with the stem 5, the electrode 7 and the current in-leads 9, as well as the base shell 15 with the base studs 25 and the insulator piece 23 are substantially the same as those described in FIG. 1. The difference appears in the layout of the seal region 11 and the resilient insert 17. The resilient insert 17 is a tubular axially corrugated body, and the means 19 for positioning the lamp base 13 are openings 19 in the mantle thereof. The further means 21 formed on the surface of the seal region 11 are protrusions 21 snapping into the openings 19. In this embodiment, four openings 19 and four protrusions 21 are formed on the seal region 11 (seen only one protrusion and one opening in this figure) but the number of the openings 19 and protrusions is not limited. The insert 17 of this type is also furnished with first tabs 27. The layout of the first tabs 27 and their connection to the lamp base 13 are substantially similar to the layout and the connection of the first tabs 27 of FIG. 1. The insert 17 wholly embraces the seal region 11 providing sufficient tightening force between the end portion of the envelope 1 and the base shell 13. The insert 17 also provides a thermal bridge between the seal region 11 and the base shell 15 and serves as a heat sink similarly to the previous case.

Figure 4:
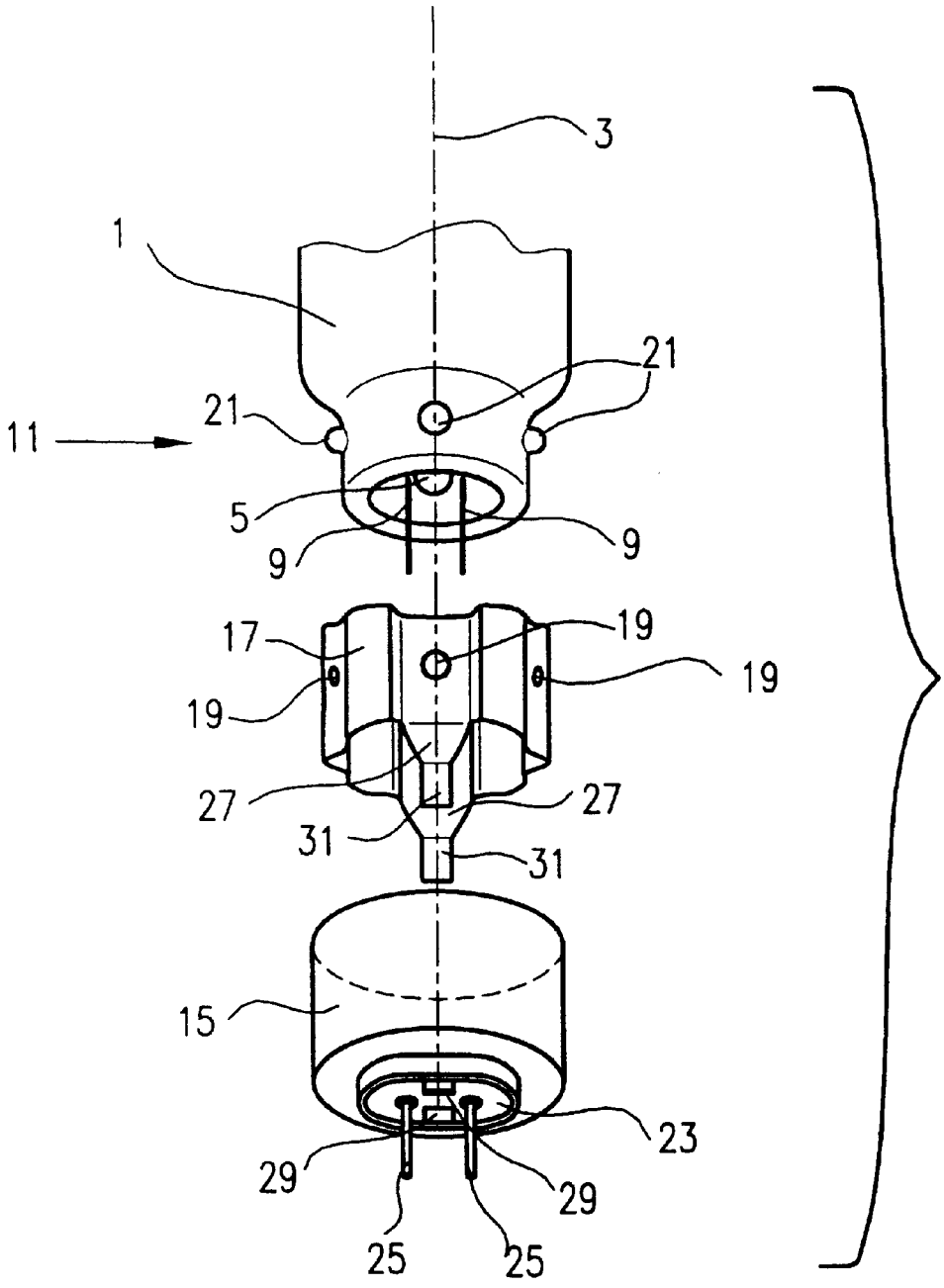
FIG. 4 illustrates an exploded view of the lamp base shown in FIG. 3.

In FIG. 4, the base shell 15, the insert 17 and the envelope 1 are illustrated separately in an exploded view in order to explain the assembly process of the embodiment of the lamp base 13 shown in FIG. 3. The insert 17 is pulled over the seal region 11 so that its corrugated body widens out until the openings 19 resiliently snap onto the protrusions 21. Then the base shell 15 with the insulator piece 23 and the base studs 25 is pulled over the insert 17, so that the tongues 31 and the current in-leads 9 are threaded in the apertures 29 and in the base studs 25, respectively. When pulling the base shell 15 over the insert 17, it fits resiliently to an interior surface of the base shell 15. Since the mantle of the insert 17 is a corrugated body, the larger diameter portion of the insert 17 leans against the inner surface of the base shell 15, the smaller diameter portion with the openings 19 clinches the outer surface of the seal region 11. Forming the insert 17 as a corrugated body is more advantageous with respect to the tightening force and the heat transfer, because a larger portion of the insert 17 leans against the outer surface of the seal region 11 as well as the inner surface of the base shell 15. Finally, the tongues 31 are bent back and the current in-leads 9 are crimped according to the procedure described with respect to FIG. 1.

In addition to the embodiments of the lamp base described above, further embodiments may fall within the scope of the present invention. For example, a lamp base that comprises an insert of C-shape provided with openings which receive protrusions of the seal region, as well as a lamp base that comprises a tubular insert of corrugated body provided with tabs which protrude into recesses of the seal region also remain within the scope of the present invention.

The embodiments of the lamp base were described above in combination with linear low pressure discharge lamps, however they may be combined with other type of low pressure discharge lamps, e.g. circular low pressure discharge lamps, germicidal lamps or compact low pressure discharge lamps.

Various modifications in structure and/or steps and/or function may be made by one skilled in the art without departing from the scope of the invention.

What is claimed is:

1. In combination with a low pressure discharge lamp comprising a glass envelope including an end portion having an axis, a stem mounted with an electrode and having a current in-lead connected to the electrode, the stem being melted into the end portion of the envelope in a gas-tight manner to form a seal region, a lamp base comprising a base shell made of metal and fitted to the seal region, a resilient insert secured to and disposed substantially in the base shell, said insert embracing the seal region at least partly and fitting resiliently to an interior surface of the base shell, said insert having means suitable for positioning the lamp base in cooperation with further means formed on the surface of the seal region, said insert has at least one first tab, each said first tab extends through an aperture made in the insulator piece and is bent back on the outer surface of said insulator piece, the base shell having an end portion closed at least partly by an insulator piece embedding a base stud made of metal and connected to the current in-lead.

2. The combination of claim 1 in which said first tab connects to said insert with a portion which is bent inwardly gradually closer the axis and is narrowing towards said insulator piece into a tongue extending substantially parallel to the axis through the aperture of the insulator piece.

3. The combination of claim 1 in which said insert has two said first tabs.

4. In combination with a low pressure discharge lamp comprising a glass envelope having an end portion, a stem mounted with an electrode and having a current in-lead connected to the electrode, the stem being melted into the end portion of the envelope in a gas-tight manner to form a seal region, a lamp base comprising a base shell made of metal and fitted to the seal region, a resilient insert disposed substantially in and secured to the base shell, said insert embracing the seal region at least partly and fitting resiliently to the seal region, said insert including at least one tab suitable for positioning the lamp base, wherein said tab snaps into a recess formed on the surface of the seal region, the base shell having an end portion closed at least partly by an insulator piece embedding a base stud made of metal and connected to the current in-lead.

5. The combination of claim 4 in which said insert has two said tabs which connect to a circumferential portion of said insert and are bent substantially radially inwardly.

6. A low pressure discharge lamp comprising:

an envelope including;

an end portion having an axis, a stem mounted with an electrode and having a current in-lead connected to the electrode, the stem forming an element of the end portion of the envelope in a gas-tight manner to form a seal region, and a lamp base including;

a metal base shell fitted to the seal region, a resilient insert comprising a tubular axially corrugated body disposed substantially in the base shell, the insert embracing the seal region at least partly and fitting resiliently to an interior surface of the base shell, said insert including at least one opening in a mantle thereof for positioning the lamp base in cooperation with at least one protrusion formed on the surface of the seal region, the base shell having an end portion closed at least partly by an insulator piece embedding a base stud made of metal and connected to the current in-lead.

7. The combination of claim 6 in which the means for positioning the lamp base is four openings in the mantle of the resilient insert, and the further means formed on the surface of the seal region is four protrusions.

* * * * *